US010095159B2

(12) United States Patent
Wakamatsu

(10) Patent No.: US 10,095,159 B2
(45) Date of Patent: Oct. 9, 2018

(54) IMAGE FORMING APPARATUS AND METHOD FOR ACQUIRING INFORMATION OF TONER CONTAINER

(71) Applicants: KABUSHIKI KAISHA TOSHIBA, Tokyo (JP); TOSHIBA TEC KABUSHIKI KAISHA, Tokyo (JP)

(72) Inventor: Masaaki Wakamatsu, Chigasaki Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/410,395

(22) Filed: Jan. 19, 2017

(65) Prior Publication Data

US 2018/0203377 A1 Jul. 19, 2018

(51) Int. Cl.
*G03G 15/08* (2006.01)

(52) U.S. Cl.
CPC ..... *G03G 15/0863* (2013.01)

(58) Field of Classification Search
None
See application file for complete search history.

(56) References Cited

U.S. PATENT DOCUMENTS

| | | | | |
|---|---|---|---|---|
| 6,137,966 | A * | 10/2000 | Uehara | G03G 21/1885 399/111 |
| 6,766,119 | B2 | 7/2004 | Urabe | |
| 6,941,082 | B2 | 9/2005 | Urabe | |
| 8,594,516 | B2 | 11/2013 | Takahashi | |
| 2008/0044195 | A1 * | 2/2008 | Higashiyama | G03G 21/1657 399/53 |
| 2011/0217067 | A1 | 9/2011 | Tokuno et al. | |
| 2013/0266340 | A1 * | 10/2013 | Hashimoto | G03G 21/1676 399/119 |
| 2014/0270859 | A1 * | 9/2014 | Hosokawa | G03G 15/0872 399/262 |

* cited by examiner

*Primary Examiner* — Victor Verbitsky
(74) *Attorney, Agent, or Firm* — Patterson & Sheridan, LLP

(57) ABSTRACT

An image forming apparatus includes a toner container attaching unit to which a toner container is to be attached, the toner container attaching unit including an apparatus-side terminal that comes into contact with a container-side terminal of the toner container and an apparatus-side coupling that engages with a container-side coupling of the toner container, and a control unit. The control unit is configured to execute a first process to acquire information of the toner container via the apparatus-side terminal, and cause the apparatus-side coupling to be rotated based on a result of the first process.

20 Claims, 8 Drawing Sheets

IMAGE FORMING APPARATUS AND METHOD FOR ACQUIRING INFORMATION OF TONER CONTAINER

FIELD

Embodiments described herein relate generally to an image forming apparatus and a method for acquiring information of a toner container.

BACKGROUND

A toner container (toner cartridge) containing toner is used when attached to an image forming apparatus. The image forming apparatus identifies whether or not a genuine toner container is attached. When attaching the toner container, a container-side coupling of the toner container and an apparatus-side coupling of the image forming apparatus are engaged with each other. If the two couplings are not properly engaged, it may not be possible to identify the toner container.

DETAILED DESCRIPTION

An image forming apparatus of an embodiment includes a toner container attaching unit to which a toner container is to be attached, the toner container attaching unit including an apparatus-side terminal that comes into contact with a container-side terminal of the toner container and an apparatus-side coupling that engages with a container-side coupling of the toner container, and a control unit. The control unit is configured to execute a first process to acquire information of the toner container via the apparatus-side terminal, and cause the apparatus-side coupling to be rotated based on a result of the first process.

Hereinafter, an image forming apparatus and a method for acquiring information of a toner container of the embodiment will be described with reference to the drawings.

Figure 1:
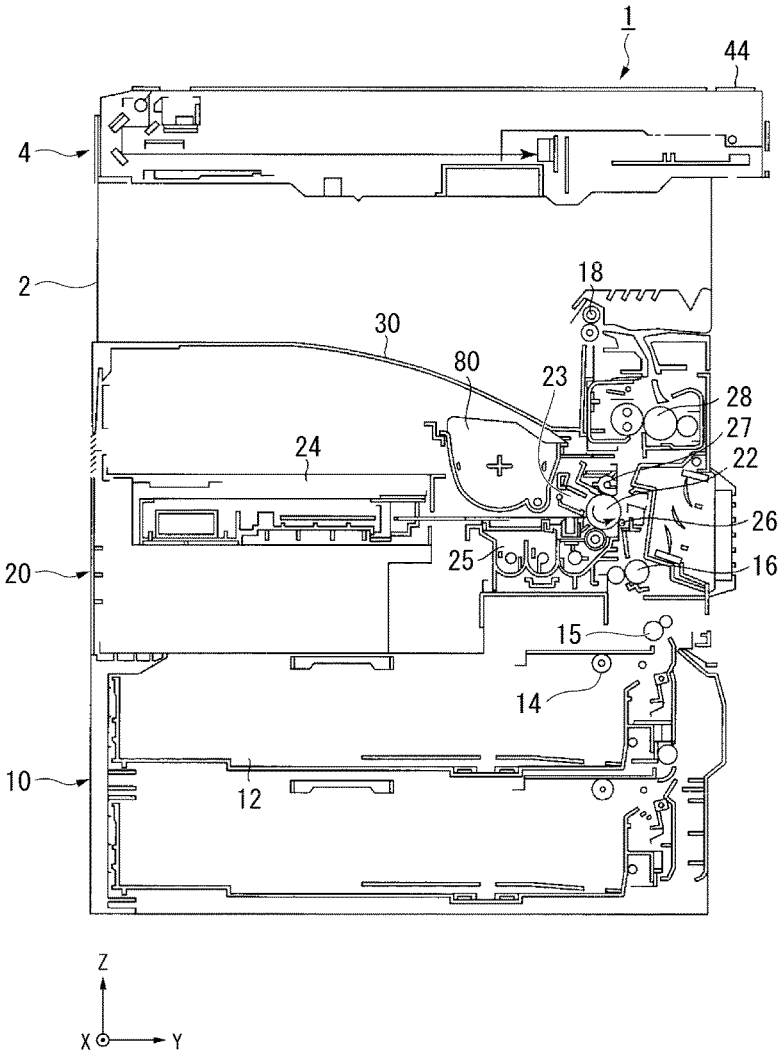
FIG. 1 is a front sectional view illustrating an image forming apparatus of an embodiment.

FIG. 1 is a sectional view illustrating a configuration example of an image forming apparatus 1 of the embodiment. For example, the image forming apparatus 1 is a Multi-Function Peripheral (MFP). The image forming apparatus 1 reads an image formed on a sheet-like recording medium such as a paper sheet and generates digital data. The image forming apparatus 1 forms the image on the sheet using a recording agent based on the digital data. A specific example of the recording agent is toner. The recording agent is one of a decolorable recording agent and a non-decolorable recording agent.

A toner material used as the decolorable recording agent has a function of decoloring if energy is applied from outside. The application of energy from the outside means to apply external stimulus such as a temperature, light having a specific wavelength, or a pressure. The "decoloring" in the embodiment means making an image formed in a color (including an achromatic such as white and black as well as chromatic) different from a color of a base of a sheet invisible.

First, an entire configuration of the image forming apparatus 1 will be described.

As illustrated in FIG. 1, an example of the image forming apparatus 1 has a housing 2, a display unit 44, a scanner unit 4, a paper feeding unit 10, and a printer unit 20. The housing (apparatus body and casing) 2 forms an outer frame of the image forming apparatus 1.

The display unit 44 is disposed on an upper surface of the housing 2. The display unit 44 includes a touch panel and the like. The display unit 44 displays various types of information regarding image formation.

The scanner unit 4 is disposed in an upper portion of the housing 2. The scanner unit 4 reads image information of a copy object as brightness of light. The scanner unit 4 outputs the read image information to the printer unit 20.

The paper feeding unit 10 supplies and conveys the sheet. The paper feeding unit 10 has a paper feeding cassette 12, a pickup roller 14, a conveying roller 15, and a registration roller 16.

The paper feeding cassette 12 is disposed in a lower portion of the housing 2. The paper feeding cassette 12 stores sheets which are subjected to the image forming process. The pickup roller 14 picks up the sheet from the sheets stored in the paper feeding cassette 12 one by one. The pickup roller 14 supplies the sheet toward the conveying roller 15.

The conveying roller 15 conveys the sheet supplied from the pickup roller 14 toward the registration roller 16. The registration roller 16 temporarily receives a front end of the conveyed sheet and corrects a skew of the sheet. The registration roller 16 supplies the sheet to the printer unit 20.

The printer unit 20 is disposed at a center portion of the housing 2. The printer unit 20 forms an image on the sheet using a developer such as toner based on the image information from the scanner unit 4 or the outside. The printer unit 20 has a photosensitive drum 22, a charger 23, an exposure device 24, a developing device 25, a transfer roller 26, a cleaning device 27, a fixing device 28, and a paper discharge roller 18. The printer unit 20 has a receiving part to receive a toner container 80.

The photosensitive drum 22 is formed in a cylindrical shape. A photosensitive material is disposed on an outer peripheral surface of the photosensitive drum 22. The photosensitive material retains static electricity in a dark environment and has a property of emitting the static electricity only from a portion to which light is irradiated. The photosensitive drum 22 rotates around a rotational axis in a predetermined rotational direction.

The charger 23 electrically charges a surface of the photosensitive drum 22. For example, the charger 23 includes a plurality of needle electrodes. The needle electrodes are arranged side by side in a direction of the rotational axis of the photosensitive drum 22. The charger 23 charges the surface of the photosensitive drum 22 with the static electricity due to discharging from the plurality of needle electrodes.

The exposure device 24 forms an electrostatic latent image corresponding to the image information on the surface of the photosensitive drum 22. For example, the exposure device 24 includes a laser irradiation device. The laser irradiation device irradiates the surface of the rotating photosensitive drum 22 with the laser based on the image information. A portion to which is irradiated with the laser among the surface of the photosensitive drum 22 discharges the static electricity and the other portion retains the static electricity. As described above, the exposure device 24 forms the electrostatic latent image corresponding to the image information on the surface of the photosensitive drum 22.

The developing device 25 supplies the toner onto the surface of the photosensitive drum 22 and develops the electrostatic latent image with the toner. For example, a two-component developer including the toner and carrier is stored in an inside of the developing device 25. The carrier passes the toner from the developing device 25 to the photosensitive drum 22. Only a portion discharging the static electricity by the exposure among the surface of the photosensitive drum 22 attracts the toner that is negatively charged. Thus, the developing device 25 develops the electrostatic latent image on the surface of the photosensitive drum 22 with the toner.

The developer such as the toner is stored in the toner container 80. The toner container 80 is disposed above the developing device 25. The toner container 80 supplies the toner to the developing device 25. The toner container 80 is attachable to/detachable from the receiving part of the printer unit 20. If the toner stored in the toner container 80 is used up, the toner container 80 is removed from the image forming apparatus 1 and new toner container 80 is attached to the image forming apparatus 1. The toner container 80 will be described later in detail.

The transfer roller 26 is arranged alongside the photosensitive drum 22. The transfer roller 26 presses the conveyed sheet against the photosensitive drum 22. The transfer roller 26 applies a plus voltage from a rear side of the sheet. Therefore, the toner that is negatively charged is transferred from the photosensitive drum 22 onto the sheet. Thus, the transfer roller 26 transfers a toner image of the photosensitive drum 22 to the sheet.

The cleaning device 27 removes the toner remaining on the surface of the photosensitive drum 22. The cleaning device 27 also removes a charge of the surface of the photosensitive drum 22.

The fixing device 28 fixes the toner image to the sheet. For example, the fixing device 28 includes a heating roller and a pressing roller. The sheet to which the toner image is transferred passes through a nip formed between the heating roller and the pressing roller. The heating roller heats the toner image on the sheet and the pressing roller presses the toner image toward the sheet. The toner is phase-changed from powder phase to a liquid phase and permeates into fibers of the sheet. The toner is solidified by being cooled and is fixed to the sheet. As described above, the fixing device 28 fixes the toner image to the sheet.

The paper discharge roller 18 discharges the sheet after the image formation to a paper discharge tray 30.

The paper discharge tray 30 receives the sheet after the image formation discharged from the paper discharge roller 18. For example, the paper discharge tray 30 is disposed between the scanner unit 4 and the printer unit 20.

Figure 2:
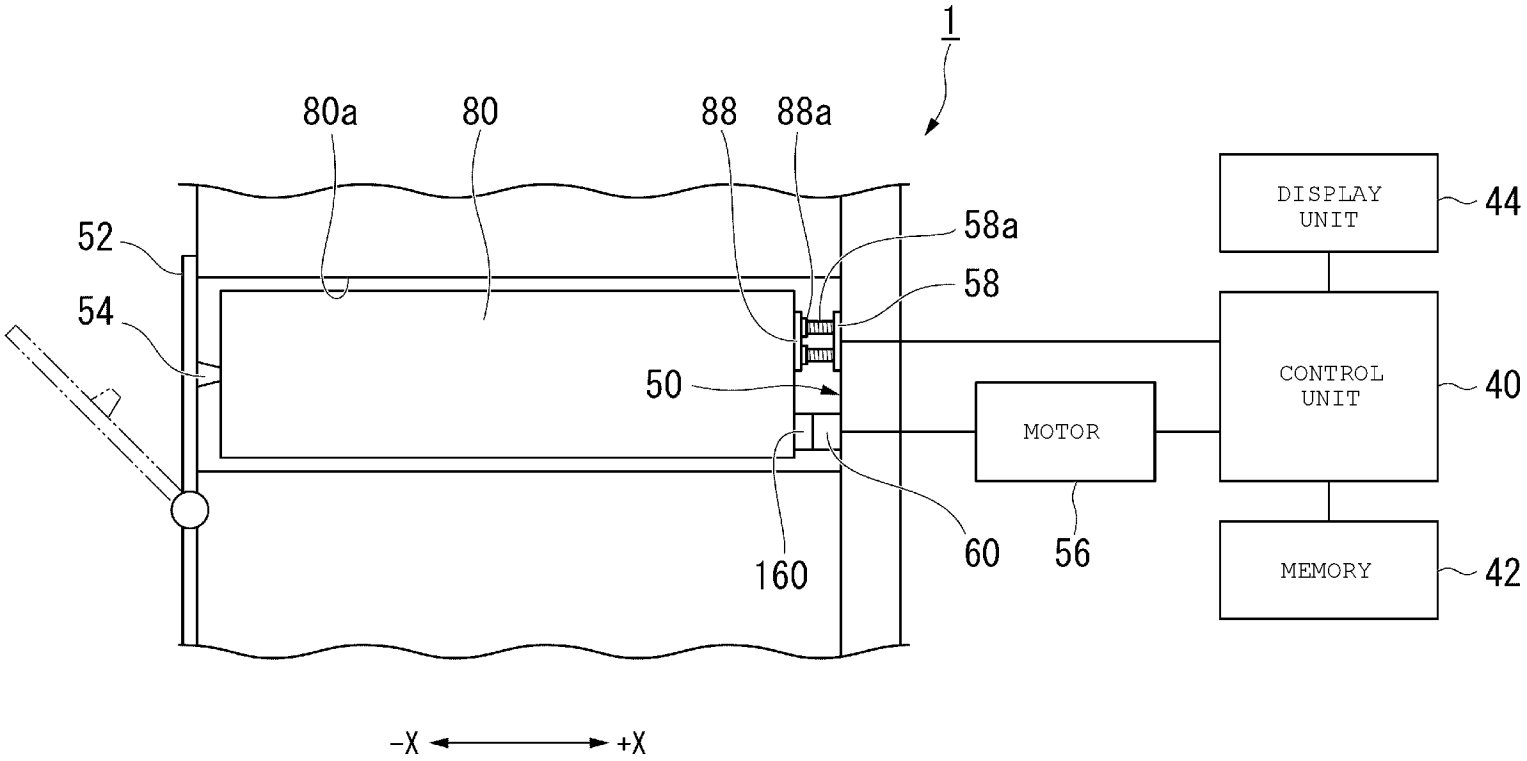
FIG. 2 is a partial side sectional view and block diagram illustrating a part of the image forming apparatus.

FIG. 2 is a partial side sectional view and block diagram illustrating a part of the image forming apparatus 1. The image forming apparatus 1 includes a receiving part 80*a* of the toner container 80, a toner container attaching unit 50, and a cover 52.

An inside shape of the receiving part 80*a* is formed corresponding to an exterior of the toner container 80. The toner container 80 is inserted into the receiving part 80*a* by moving in a longitudinal direction. In the present application, the longitudinal direction of the toner container 80 is an X direction. In addition, in an inserting operation of the toner container 80, a leading direction is a +X direction (first direction) and a direction opposite thereto is a −X direction (second direction). When the toner container 80 is attached, the toner container attaching unit 50 is at a position facing the end surface of the toner container 80 in the +X direction. An inner surface of the cover 52 faces the end surface of the toner container 80 in the −X direction in a closed state thereof when the toner container 80 is attached. The cover 52 can be moved between an opened state in which the toner container 80 can be inserted into the receiving part 80*a* and a closed state in which the toner container 80 cannot be inserted into the receiving part 80*a*. A protrusion 54 is formed on an inner surface of the cover 52. The protrusion 54 is capable of pressing the toner container 80 which is attached to the receiving part 80*a* toward the toner container attaching unit 50 in the +X direction in the closed state.

Figure 3:
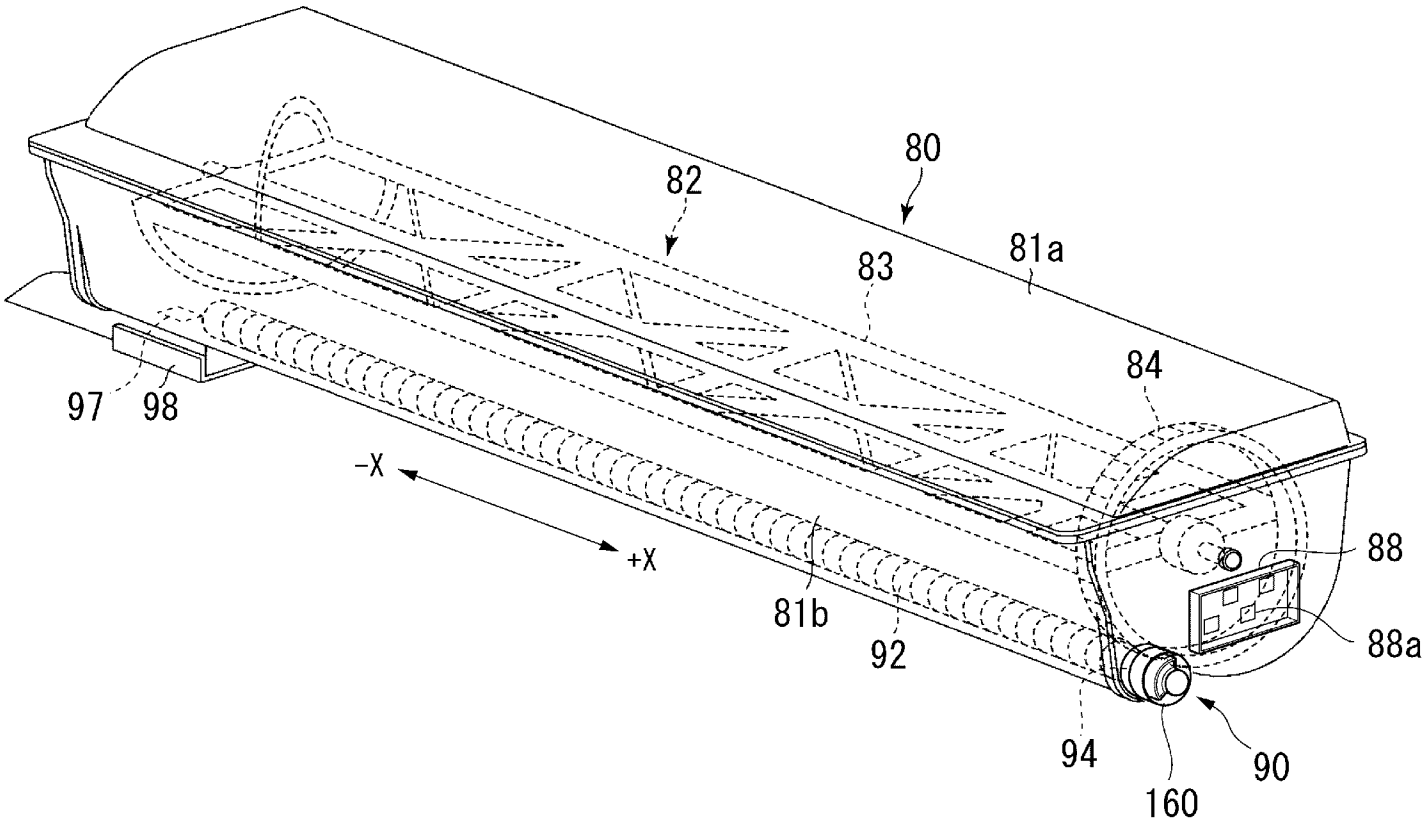
FIG. 3 is a perspective view illustrating a toner container.

FIG. 3 is a perspective view illustrating the toner container 80. The toner container 80 includes a case 81, a toner supply unit 90, a toner stirring unit 82, and an information storage unit 88.

The case 81 is formed by combining a first case 81*a* disposed above and a second case 81*b* disposed below. The first case 81*a* is attachable to/detachable from the second case 81*b*.

The toner supply unit 90 is disposed in a lower portion of the toner container 80. The toner supply unit 90 includes an auger 92, a container-side coupling 160, a toner discharge port 97, and a discharge port cover 98.

The auger 92 is disposed in a bottom portion of the second case 81*b*. The auger 92 extends in the X direction. The auger 92 is formed in a screw shape. Vicinities of the both ends of the auger 92 in the X direction are rotatably supported on both side walls of the second case 81*b* in the X direction.

Figure 4:
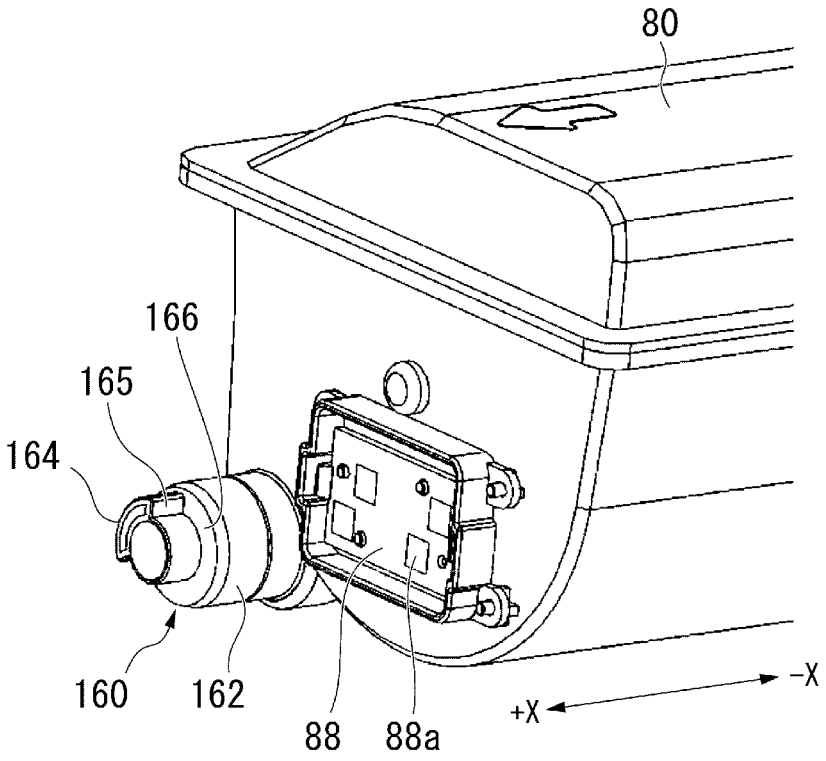
FIG. 4 is a partial perspective view illustrating an end portion of the toner container.

FIG. 4 is a partial perspective view illustrating the end portion of the toner container in the +X direction. The container-side coupling 160 is integrally formed by a resin material, a metal material, or the like. The container-side coupling 160 includes a base portion 162, a projection portion 164, and a recessed portion 166. The base portion 162 is formed in a disk shape.

The projection portion 164 is formed so as to protrude from the end surface of the base portion 162 in the +X direction to the +X direction. The projection portion 164 is formed in an arc shape viewed from the X direction. The projection portion 164 is disposed along a peripheral edge portion of the end surface of the base portion 162 in the +X direction. The recessed portion 166 is formed in a region other than the formation region of the projection portion 164 along the peripheral edge portion of the end surface of the base portion 162 in the +X direction.

As illustrated in FIG. 3, the container-side coupling 160 is fixed to the end portion of the auger 92 protruding to the outside of the second case 81*b* in the +X direction. The container-side coupling 160 is disposed coaxially with the auger 92. When rotating the container-side coupling 160, the auger 92 rotates around a rotational axis. Thus, the toner in the bottom portion of the second case 81*b* is conveyed from the +X direction to the −X direction.

The toner discharge port 97 is disposed in the vicinity of the end portion of the auger 92 in the −X direction. The toner discharge port 97 is formed so as to penetrate the bottom surface of the second case 81*b* as shown in FIG. 3. The discharge port cover 98 is formed so as to cover the outside of the toner discharge port 97. When attaching the toner container 80 on the image forming apparatus 1, the discharge port cover 98 is moved and the toner discharge port 97 is exposed. Therefore, the toner stored in the toner container 80 is supplied from the toner discharge port 97 to the developing device 25.

The toner stirring unit 82 is disposed in the center portion of the toner container 80. The toner stirring unit 82 includes a stirring paddle 83 and a paddle gear 84.

The stirring paddle 83 is formed in a mesh plate shape. The stirring paddle 83 extends in the X direction. Both end portions of the stirring paddle 83 in the X direction are rotatably supported on both side walls of the second case 81*b* in the X direction. The paddle gear 84 is rotatably supported in the vicinity of the end portion of the stirring paddle 83 in the +X direction. The paddle gear 84 meshes with an auger gear 94 fixed to the vicinity of the end portion of the auger 92 in the +X direction. When rotating the container-side coupling 160 in a predetermined direction, the stirring paddle 83 is rotated via the auger gear 94 and the paddle gear 84. Thus, the toner stored in the toner container 80 is stirred.

As illustrated in FIG. 4, the information storage unit 88 is provided on an outer surface of the side wall of the second case 81*b* in the +X direction. The information storage unit 88 includes a storage element, such as an IC chip, therein. Identification information of the toner container is stored in the storage element. The information storage unit 88 includes a container-side terminal 88*a* on a surface thereof. The container-side terminal 88*a* is a flat metal pad. The container-side terminal 88*a* is electrically connected to the storage element. The information storage unit 88 of the embodiment includes a plurality of container-side terminals 88*a*.

Figure 5:
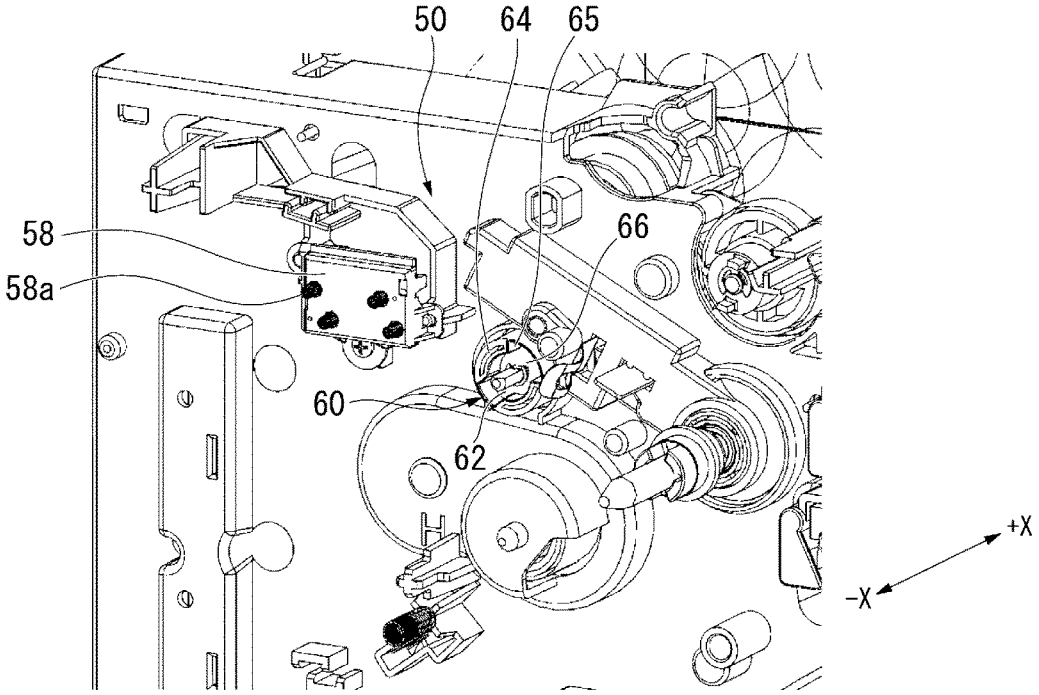
FIG. 5 is a partial perspective view illustrating a toner container attaching unit of the image forming apparatus.

FIG. 5 is a partial perspective view illustrating the toner container attaching unit in the image forming apparatus. The toner container attaching unit 50 is provided to face the end surface of the toner container 80 in the +X direction when the toner container 80 is inserted into the receiving part 80*a*. The toner container attaching unit 50 includes an apparatus-side coupling 60 and a contact portion 58.

The apparatus-side coupling 60 is integrally formed by a resin material, a metal material, or the like. The apparatus-side coupling 60 includes a base portion 62, a projection portion 64, and a recessed portion 66. The base portion 62 is formed in a disk shape.

The projection portion 64 is formed so as to protrude from the end surface in the −X direction of the base portion 62 to the −X direction. The projection portion 64 is formed in an arc shape viewed from the X direction. The projection portion 64 is disposed along a peripheral edge portion of the end surface of the base portion 62 in the −X direction. The apparatus-side coupling 60 of the embodiment includes a pair of projection portions 64. The recessed portion 66 is disposed in a region between a pair of projection portions along the peripheral edge portion of the end surface of the base portion 62 in the −X direction.

The projection portion 64 of the apparatus-side coupling 60 is formed to be capable of fitting to the recessed portion 166 of the container-side coupling 160. The recessed portion 66 of the apparatus-side coupling 60 is formed to be capable of fitting to the projection portion 164 of the container-side coupling 160. If each thereof is fitted, the apparatus-side coupling 60 and the container-side coupling 160 are engaged. In this state, a side surface 65 of the projection portion 64 of the apparatus-side coupling 60 is able to abut against a side surface 165 of the projection portion 164 of the container-side coupling 160. When rotating the apparatus-side coupling 60, the side surface 65 presses the side surface 165 and a torque is transmitted to the container-side coupling 160. Thus, the container-side coupling 160 is rotated.

The contact portion 58 includes an apparatus-side terminal 58*a*. The apparatus-side terminal 58*a* is formed of an elastic member having conductivity. For example, the apparatus-side terminal 58*a* is formed of a metal coil spring. The contact portion 58 of the embodiment includes a plurality of apparatus-side terminals 58*a*. The apparatus-side terminals 58*a* are arranged in positions corresponding to the container-side terminals 88*a*.

Figure 6:
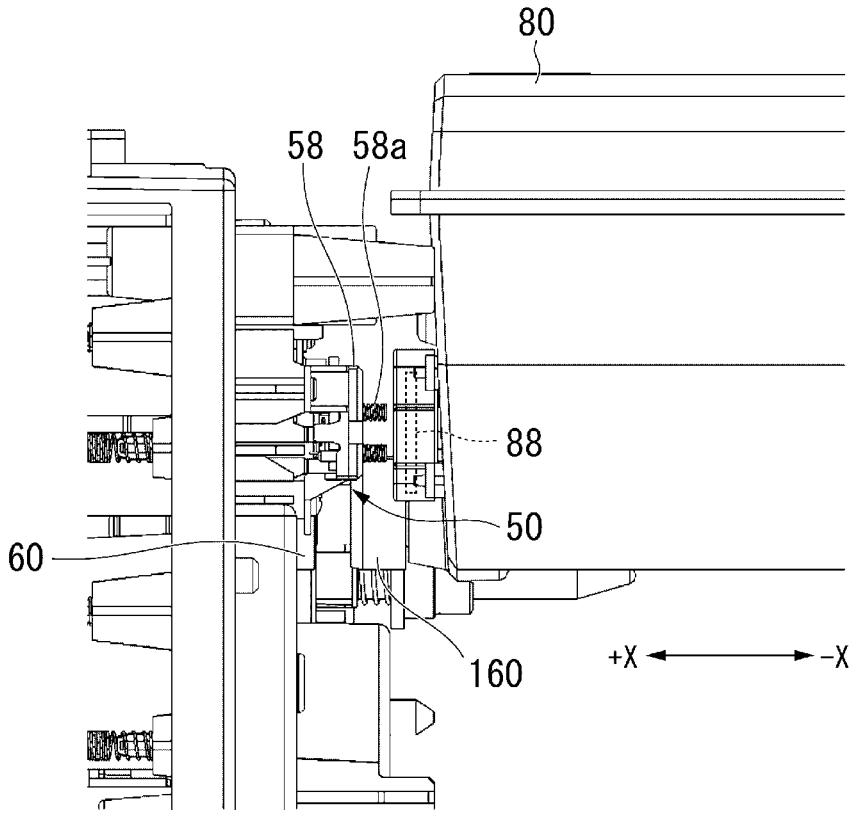
FIG. 6 is a partial side view illustrating a state before attaching of the toner container.
Figure 7:
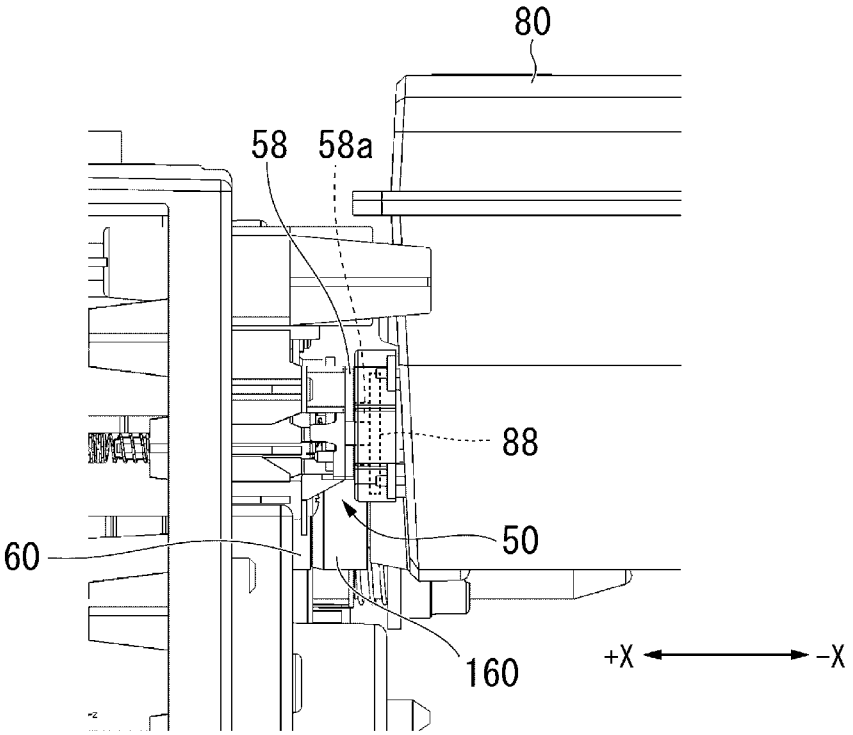
FIG. 7 is a partial side view illustrating a state after attaching of the toner container.

FIG. 6 is a partial side view illustrating a state before attaching the toner container. FIG. 7 is a partial side view illustrating a state after attaching the toner container. When attaching the toner container 80, as illustrated in FIG. 6, the toner container 80 is moved toward the toner container attaching unit 50 in the +X direction. Then, as illustrated in FIG. 7, the apparatus-side coupling 60 and the container-side coupling 160 are engaged. In addition, the apparatus-side terminal 58*a* of the contact portion 58 of the toner container attaching unit 50 comes into contact with the container-side terminal 88*a* of the information storage unit 88 of the toner container 80. Thus, the toner container 80 is normally attached to the toner container attaching unit 50. The apparatus-side terminal 58*a* is formed of an elastic member having conductivity. Thus, even when a relative position between the toner container 80 and the toner container attaching unit 50 varies, the apparatus-side terminal 58*a* reliably comes into contact with the container-side terminal 88*a*.

As illustrated in FIG. 2, the image forming apparatus 1 includes a motor 56, a control unit 40, a memory 42, and the display unit 44. The motor 56 rotates the apparatus-side coupling 60. The control unit 40 controls an operation of the motor 56 and the contact portion 58 as described below. A program for operating the control unit 40 is stored in the memory 42. For example, the memory 42 is a flash memory. The display unit 44 displays various types of information based on signals from the control unit 40.

Figure 8:
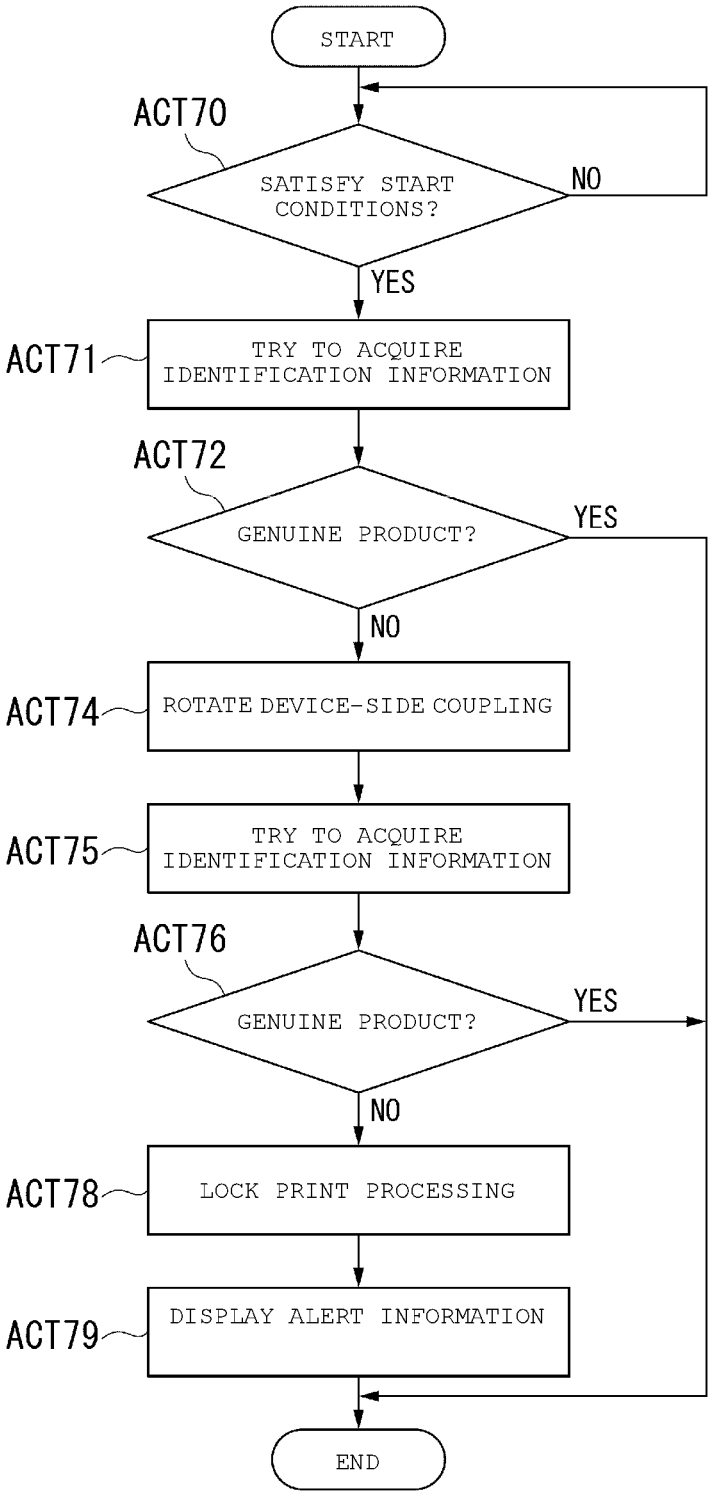
FIG. 8 is a flowchart illustrating an operation example of the image forming apparatus.

FIG. 8 is a flowchart illustrating an operation example of the image forming apparatus. The control unit 40 is configured to execute an identification processing of the toner container as follows. The identification processing is provided for identifying whether or not the toner container 80 attached to the image forming apparatus 1 is a genuine product. The identification processing includes a method for acquiring information of the toner container 80.

The control unit 40 determines whether start conditions of the identification processing are satisfied (ACT70). The control unit 40 determines that the start conditions of the identification processing are satisfied when one of a first start condition and a second start condition is satisfied. The satisfaction of the first start condition means that power supply of the image forming apparatus 1 is turned on. A new toner container 80 can be attached when power supply is turned off. Thus, the identification processing is executed when power supply is turned on. The satisfaction of the second start condition means that the cover 52 is closed. The image forming apparatus 1 may not have a function to detect the attaching of the new toner container 80. The image forming apparatus 1 cannot detect the attaching of the new toner container 80 even in a state where power supply is turned on. The toner container 80 is received in the receiving part 80*a* by closing the cover 52 and is attached to the image forming apparatus 1. Therefore, the identification processing is executed when the cover 52 is closed.

When the start conditions of the identification processing are satisfied (ACT70: Yes), the control unit 40 executes a first trial processing to try to obtain the identification information of the toner container 80 (ACT71). The control unit 40 tries to acquire the identification information of the toner container 80 stored in the information storage unit 88 of the toner container 80 via the contact portion 58 of the toner container attaching unit 50. If the toner container 80 is normally attached to the toner container attaching unit 50, the control unit 40 can acquire the identification information of the toner container 80.

The control unit 40 determines whether or not the toner container 80 is the genuine product (ACT72). The control unit 40 compares the acquired identification information and the identification information of the genuine product. The identification information of the genuine product is stored in the memory 42 in advance. The control unit 40 compares the identification information of the genuine product with the acquired identification information that is read from the memory 42. The control unit 40 determines that the toner container is the genuine product if the acquired identification information matches the identification information of the genuine product (ACT72: Yes). In this case, the control unit 40 completes the identification processing without locking a print processing of the image forming apparatus 1.

The toner container 80 of the genuine product includes the container-side coupling engaging with the apparatus-side coupling 60. Therefore, the toner container 80 is able to be normally attached to the toner container attaching unit 50. In this case, the control unit can acquire the identification information of the toner container 80. On the other hand, the toner container 80 that is not the genuine product often includes a container-side coupling that is not engaged with the apparatus-side coupling 60. In this case, the toner container 80 is not normally attached to the toner container attaching unit 50. Therefore, the control unit 40 fails to acquire the identification information of the toner container 80. If the control unit 40 fails to acquire the identification information of the toner container 80, the control unit 40 determines that the toner container 80 is not the genuine product (ACT72: No).

Meanwhile, even if the toner container 80 is the genuine product, the toner container 80 may not be normally attached to the toner container attaching unit 50. When inserting the toner container 80 into the receiving part 80*a*, the projection portion 64 of the container-side coupling 160 may abut against the projection portion 64 of the apparatus-side coupling (see FIG. 5). In this case, the apparatus-side terminal 58*a* of the contact portion 58 of the toner container attaching unit 50 does not normally come into contact with the container-side terminal 88*a* of the information storage unit 88 of the toner container 80. As described above, the toner container 80 may not be normally attached to the toner container attaching unit 50. In this case, the control unit 40 fails to acquire the identification information that is stored in the information storage unit 88 even if the toner container 80 is the genuine product. In this case, the control unit 40 determines that the toner container 80 is not the genuine product (ACT72: No).

If it is determined that the toner container 80 is not the genuine product (ACT72: No), the control unit 40 controls the motor 56 to rotate the apparatus-side coupling 60 (ACT74). The control unit 40 controls the motor 56 to rotate the apparatus-side coupling 60 by one turn (rotates by 360 degrees). If the toner container 80 is the genuine product, the apparatus-side coupling 60 passes through an engageable angular position with the container-side coupling 160 during one turn. The engageable angular position is a relative position of two couplings in which the two couplings are capable of engaging by moving the toner container 80 in the +X direction. The protrusion 54 of the cover 52 presses the toner container 80 toward the toner container attaching unit 50 in the +X direction. Therefore, when the apparatus-side coupling 60 passes through the engageable angular position, the container-side coupling 160 and the apparatus-side coupling 60 are engaged. Therefore, the apparatus-side terminal 58*a* of the contact portion 58 of the toner container attaching unit 50 comes into contact with the container-side terminal 88*a* of the information storage unit 88 of the toner container 80. Thus, the toner container 80 of the genuine product is normally attached to the toner container attaching unit 50, when the projection portion 64 of the container-side coupling 160 abuts against the projection portion 64 of the apparatus-side coupling.

The control unit 40 executes again a second trial processing for trying to acquire the identification information of the toner container 80 (ACT75). The control unit 40 tries to acquire the identification information of the toner container stored in the information storage unit 88 of the toner container 80 via the contact portion 58 of the toner container attaching unit 50.

The control unit 40 determines whether or not the toner container 80 is the genuine product (ACT76). A specific determining method is similar to ACT72. Since the apparatus-side coupling 60 is rotated in ACT74, the toner container 80 of the genuine product is normally attached to the toner container attaching unit 50. Therefore, the control unit 40 can acquire the identification information in ACT75 even if the acquisition of the identification information is failed in ACT71. The control unit 40 determines that the toner container 80 is the genuine product if the acquired identification information matches the identification information of the genuine product (ACT76: Yes). In this case, the control unit 40 completes the identification processing without locking the print processing of the image forming apparatus.

Further, the toner container 80 that is not the genuine product may often include a container-side coupling that do not match with the apparatus-side coupling 60. In this case, even when the apparatus-side coupling 60 is rotated in ACT74, the toner container 80 is not attached to the toner container attaching unit 50. In this case, the control unit 40 fails to acquire the identification information of the toner container 80 thereby determining that the toner container 80 is not the genuine product (ACT76: No). Moreover, even if the toner container 80 is not the genuine product, if the toner container 80 includes the container-side coupling which matches with the apparatus-side coupling 60, the toner container 80 can be attached to the toner container attaching unit 50. In this case, the control unit 40 can acquire the identification information. However, since the acquired identification information does not match the identification information of the genuine product, the control unit 40 determines that the toner container 80 is not the genuine product (ACT76: No).

If it is determined that the toner container 80 is not the genuine product (ACT76: No), the control unit 40 locks the print processing (ACT78). In addition, the control unit 40 controls the display unit 44 (see FIG. 2) to display an alert information. For example, the control unit 40 controls the display unit 44 to display the alert information and then display a message such as "make sure the toner cartridge is genuine toner cartridge". Therefore, the control unit 40 completes the identification processing.

As described above in detail, the control unit 40 executes the first trial processing for trying to acquire the identification information of the toner container 80 via the apparatus-side terminal 58*a* (ACT71). The control unit 40 controls the motor 56 to rotate the apparatus-side coupling 60 based on a result of the first trial processing (ACT74). Even if the toner container 80 of the genuine product is attached, the container-side coupling 160 may not be normally engaged with the apparatus-side coupling 60. In this case, the acquisition of the identification information as the result of the first trial processing is failed. The control unit 40 controls the motor 56 to rotate a drive-side coupling based on the result. If the toner container 80 is the genuine product, the container-side coupling 160 is engaged with the apparatus-side coupling 60. Therefore, the container-side terminal 88*a* comes into contact with the apparatus-side terminal 58*a*. As a result, the control unit 40 can identify whether or not the toner container 80 is the genuine product.

The control unit 40 controls the motor 56 to rotate the apparatus-side coupling 60 by one turn in ACT74. If the toner container 80 is the genuine product, when the apparatus-side coupling 60 passes through the engageable angular position with the container-side coupling 160 during one turn. Therefore, the container-side coupling 160 is normally engaged with the apparatus-side coupling 60 after rotating the apparatus-side coupling 60.

If the identification information of the toner container 80 is acquired as a result of the first trial processing (ACT72: No), the control unit 40 controls the motor 56 to rotate the apparatus-side coupling 60 (ACT74). As described above, if the toner container 80 of the genuine product is not normally attached, the acquisition of the identification information of the toner container 80 is failed. When rotating the apparatus-side coupling 60 by driving the motor 56, the toner container 80 of the genuine product is normally attached. In this case, the control unit 40 is successful in the acquisition of the identification information of the toner container. Therefore, the control unit 40 is capable of identifying whether or not the toner container 80 is the genuine product.

After rotating the apparatus-side coupling 60 in ACT74, the control unit 40 executes the second trial processing for trying to acquire the identification information of the toner container 80 via the apparatus-side terminal 58*a* (ACT75). If the identification information of the toner container 80 is not acquired as a result of the second trial processing (ACT76: No), the control unit 40 prohibits the image forming processing (ACT78). When rotating the drive-side coupling in ACT74, the toner container 80 of the genuine product is normally attached. In this case, the control unit 40 can acquire the identification information of the toner container 80 as the result of the second trial processing. On the other hand, if the identification information of the toner container 80 as the result of the second trial processing is not acquired, the control unit 40 determines that the toner container 80 is not the genuine product. Therefore, the control unit 40 can identify whether or not the toner container 80 is the genuine product. The control unit 40 prohibits the image forming processing if the toner container 80 is not the genuine product. Thus, it is possible to prevent the toner container 80 that is not the genuine product from being used.

The toner container 80 moves in the +X direction and is attached to the toner container attaching unit 50. If the toner container 80 is attached, the toner container attaching unit 50 is provided in a position facing the end surface of the toner container 80 in the +X direction. The apparatus-side coupling 60 and the apparatus-side terminal 58*a* are provided in the toner container attaching unit 50. If the container-side coupling 160 and the apparatus-side coupling 60 are not normally engaged, the container-side terminal 88*a* does not come into contact with the apparatus-side terminal 58*a*. In this case, the control unit 40 fails to acquire the identification information of the toner container 80. In contrast, the control unit 40 of the image forming apparatus 1 of the embodiment can reliably acquire the identification information of the toner container 80 by executing the operation described above.

If the toner container 80 is attached, the image forming apparatus 1 includes the cover 52 in which the inner surface of the cover 52 faces the end surface of the toner container 80 in the −X direction in the closed state thereof when the toner container 80 is attached. The cover 52 is capable of pressing the toner container 80 by the protrusion 54 in the +X direction. If the control unit 40 controls the motor 56 to rotate the apparatus-side coupling 60, the apparatus-side coupling 60 passes through the engageable angular position with the container-side coupling 160. Here, if the cover 52 presses the toner container 80 in the +X direction, the container-side coupling 160 moves in the +X direction and engages with the apparatus-side coupling 60. Therefore, the container-side coupling 160 and the apparatus-side coupling 60 are normally engaged.

If power supply of the image forming apparatus 1 is turned on (ACT70: Yes), the control unit executes the first trial processing (ACT71). When power supply is turned off, the new toner container 80 is able to be attached. Therefore, when power supply is turned on, it is possible to prevent the toner container 80 that is not the genuine product from being used by executing the identification processing.

The image forming apparatus 1 includes the cover 52 which is capable of opening and closing the receiving part 80*a* of the toner container 80. If the cover 52 is closed (ACT70: Yes), the control unit 40 executes the first trial processing (ACT71). The image forming apparatus 1 may not have a function of detecting the attaching of the new toner container 80 even in a state that power supply is turned on. The toner container 80 is received in the receiving part 80*a* by opening the cover 52 and is attached to the image forming apparatus 1. Therefore, it is possible to prevent the toner container 80 that is not the genuine product from being used by executing the identification processing when the cover 52 is closed.

The apparatus-side terminal 58*a* is formed of an elastic member having conductivity. Therefore, even if the relative position between the toner container 80 and the toner container attaching unit 50 varies, the apparatus-side terminal 58*a* reliably comes into contact with the container-side terminal 88*a*.

The image forming apparatus 1 of the embodiment has one toner container 80. In contrast, the image forming apparatus 1 may have a plurality of toner containers 80 if a color image is formed and the like.

The control unit 40 of the embodiment controls the motor 56 to rotate the apparatus-side coupling by one turn in ACT74. In contrast, the control unit 40 may rotate the apparatus-side coupling 60 exceeding one turn. In this case, it is possible to further reliably engage the two couplings. Moreover, when the apparatus-side coupling 60 is rotated by one turn, N engageable angular positions may be provided at equal interval. In this case, the control unit 40 may control the motor 56 to rotate the apparatus-side coupling 60 by 1/N turn.

The apparatus-side terminal 58*a* of the embodiment is formed of the elastic member having the conductivity. In contrast, the container-side terminal 88*a* may be formed of the elastic member having the conductivity. In addition, both terminals may be formed of the elastic member having the conductivity.

According to at least one of the embodiments described above, the control unit 40 executes the first trial processing for trying to acquire the identification information of the toner container 80 via the apparatus-side terminal 58*a* (ACT71). The control unit 40 controls the motor 56 to rotate the apparatus-side coupling 60 based on the result of the first trial processing (ACT74). Therefore, the control unit 40 can identify whether or not the toner container 80 is the genuine product.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a toner container attaching unit to which a toner container, having an auger extending inwardly thereof, is to be attached, the toner container attaching unit including an apparatus-side terminal that comes into contact with a container-side terminal of the toner container, and an apparatus-side coupling that engages with a container-side coupling that is fixed to an end of the auger; and a control unit configured to execute a first process to acquire identification information about the toner container via the apparatus-side terminal, and cause the apparatus-side coupling to be rotated or not rotated based on a result of the first process.

2. The apparatus according to claim 1, further comprising:

a motor connected to the apparatus-side coupling, wherein the control unit controls the motor to rotate the apparatus-side coupling by one turn.

3. The apparatus according to claim 1, wherein the control unit causes the apparatus-side coupling to be rotated if the identification information about the toner container is not acquired as a result of the first process.

4. The apparatus according to claim 1, wherein the control unit is configured to execute a second process to acquire the identification information about the toner container via the apparatus-side terminal after causing the apparatus-side coupling to be rotated and prohibits an image forming process in the image forming apparatus if the identification information about the toner container is not acquired as a result of the second process.

5. The apparatus according to claim 1, wherein the toner container is moved in a longitudinal direction of the toner container when being attached to the toner container attaching unit, and wherein the toner container attaching unit faces the toner container as an end surface of the toner container in the longitudinal direction of the toner container is attached to the toner container attaching unit.

6. The apparatus according to claim 5, further comprising:

a cover that presses the toner container in the longitudinal direction of the toner container against the toner container attaching unit when the cover is in a closed position.

7. The apparatus according to claim 6, wherein the control unit executes the first process responsive to a closing of the cover.

8. The apparatus according to claim 1, wherein the control unit executes the first process responsive to a powering on of the image forming apparatus.

9. The apparatus according to claim 1, wherein at least one of the apparatus-side terminal and the container-side terminal is formed of an elastic member having conductivity.

10. The method according to claim 1, wherein the identification information acquired by control unit includes identification information to provide whether the toner container is genuine as a product.

11. A method for acquiring identification information about a toner container, having an auger extending inwardly thereof, being attached to a toner container attaching unit of an image forming apparatus, the toner container attaching unit including an apparatus-side terminal that is arranged to come into contact with a container-side terminal of the toner container, and an apparatus-side coupling that is arranged to engage with a container-side coupling that is fixed to an end of the auger, the method comprising:

executing a first process to acquire the identification information about the toner container via the apparatus-side terminal of the image forming apparatus; and rotating or not rotating the apparatus-side coupling of the image forming apparatus based on a result of the first process.

12. The method according to claim 11, further comprising:

controlling a motor connected to the apparatus-side coupling to rotate the apparatus-side coupling by one turn.

13. The method according to claim 11, wherein the apparatus-side coupling is rotated if the identification information about the toner container is not acquired as a result of the first process.

14. The method according to claim 11, further comprising:

executing a second process to acquire the identification information about the toner container via the apparatus-side terminal after the apparatus-side coupling is rotated; and prohibiting an image forming process in the image forming apparatus if the identification information about the toner container is not acquired as a result of the second process.

15. The method according to claim 11, wherein the toner container is moved in a longitudinal direction of the toner container when being attached to the toner container attaching unit, and wherein the toner container attaching unit faces the toner container as an end surface of the toner container in the longitudinal direction of the toner container is attached to the toner container attaching unit.

16. The method according to claim 15, further comprising:

closing a cover that presses the toner container in the longitudinal direction of the toner container against the toner container attaching unit.

17. The method according to claim 16,
wherein the first process is executed responsive to a closing of the cover.

18. The method according to claim 11,
wherein the first process is executed responsive to a powering on of the image forming apparatus.

19. The method according to claim 11,
wherein at least one of the apparatus-side terminal and the container-side terminal is formed of an elastic member having conductivity.

20. The method according to claim 11,
wherein the identification information acquired by control unit includes identification information to provide whether the toner container is genuine as a product.

* * * * *